United States Patent [19]

Veal et al.

[11] 4,276,053

[45] Jun. 30, 1981

[54] FUEL COMPOSITION AND METHOD FOR ITS PREPARATION

[75] Inventors: Christopher J. Veal, London; Derek R. Wall, Farnham, both of England

[73] Assignee: The British Petroleum Company Limited, London, England

[21] Appl. No.: 100,215

[22] Filed: Dec. 4, 1979

[30] Foreign Application Priority Data

Dec. 13, 1978 [GB] United Kingdom ..... 48364/78

[51] Int. Cl.[3] ..... C10L 1/32

[52] U.S. Cl. ..... 44/51; 44/1 F; 44/61

[58] Field of Search ..... 44/51, 1 F, 61; 208/8 R

[56] References Cited

U.S. PATENT DOCUMENTS 2,231,513 2/1941 Stillman ..... 44/51

FOREIGN PATENT DOCUMENTS 1523193 8/1978 United Kingdom .

*Primary Examiner*—Patrick Garvin
*Assistant Examiner*—J. V. Howard
*Attorney, Agent, or Firm*—Morgan, Finnegan, Pine, Foley & Lee

[57] ABSTRACT

A stable, uniform solvent refined coal (SRC)—oil dispersion is prepared by grinding 15 to 55% by weight of SRC particles in the absence of free oxygen in a medium consisting essentially of gas oil and/or a heavier petroleum fraction. Grinding is continued until the size of the majority of the particles is reduced to a value in the range 1 to 10 micron. Preferably the SRC is uniformly dispersed in the gas oil and/or heavier petroleum fraction prior to grinding.

9 Claims, No Drawings

FUEL COMPOSITION AND METHOD FOR ITS PREPARATION

This invention relates to the production of dispersions of solvent refined coal, hereinafter termed SRC, and oil.

Coal oil slurries have previously been disclosed, see for example, British Pat. No. 975,687. Whilst these behave as near Newtonian non-settling fluids in pipelines, they separate on standing. Thus such slurries are suitable for use immediately after preparation or pipelining but are not suitable for transportation by tanker nor for storage.

British Pat. No. 396,432 discloses the preparation of coal oil mixtures in which coal is preground before being contacted with oil. The coal is not ground in the presence of the oil. After mixing, the blend of coal and oil is passed through a homogeniser which disperses the coal particles uniformly in the oil but does not reduce their size.

Our British Pat. No. 1,523,193 discloses a method for the preparation of a uniform coal oil dispersion which method comprises grinding coal in a medium consisting essentially of gas oil and/or a heavier petroleum fraction until the particle size is reduced to a value below 10 micron and the dispersion contains 15 to 55% by weight coal, expressed as a percentage by weight of the total dispersion and until a stable dispersion results on ceasing grinding.

By "stable dispersion" is meant a dispersion which does not separate into layers of its constituent compounds on standing at ambient temperature for at least six months.

Coal, however is a complex organic mineral of high molecular weight.

Solvent refined coal, although derived from coal, has different properties in many respects, e.g. molecular weight, hydrogen content and the nature of its surface.

We have now discovered stable SRC oil dispersions which are suitable for pumping and storage and a method for their preparation.

Thus, according to one aspect of the present invention there is provided a uniformly dispersed, stable fuel dispersion containing 15 to 55% by weight, preferably 30 to 40% by weight, of SRC particles, the size of the majority of the particles being in the range 1 to 10 micron, in a medium consisting essentially of a gas oil and/or a heavier petroleum fraction, the percentage being expressed as a percentage by weight of the total weight of the dispersion.

According to another aspect of the present invention there is provided a method for the preparation of a stable, uniform SRC-oil dispersion which method comprises grinding 15 to 55%, preferably 30 to 40%, by weight of SRC particles in the absence of free oxygen in a medium consisting essentially of gas oil and/or a heavier petroleum fraction until the size of the majority of the particles is reduced to a value in the range 1 to 10 micron, the percentage being expressed as a percentage by weight of the total weight of the dispersion.

An important feature of the invention is the stability of the SRC oil dispersions produced. This stability is a function of three variables: the method of grinding in the presence of the oil, the final particle size and the final concentration of SRC in oil. If all three are chosen correctly, then the resulting dispersion is in the form of a gel which is a physical network formed by the SRC particles in the oil. It is a uniform structure in which the SRC particles cannot settle out, because they form part of it. This is unlike all previous coal oil dispersions which have been either slurries in which the coal particles are suspended in the oil from which they will eventually settle out or dispersions in which the coal particles are of colloidal size maintained in suspension by the Brownian movement.

If the SRC is not ground in the oil, the gel will not form. If the SRC particle size is too great, the gel will not form and the particles will settle out. The concentration of the SRC particles is also critical. If it is too high or too low, the gel will not form.

Grinding can be carried out in vibratory, agitatory or tumbling ball mills.

It is necessary to exclude free oxygen, e.g. air, during the grinding operation. This can easily be achieved in the case of vibratory and agitatory ball mills by filling the mill completely. In the case of a tumbling ball mill, it is not practical to fill the mill completely and the milling should be carried out under an inert gaseous atmosphere, e.g., a blanket of nitrogen.

When using a ball mill, it is, of course, desirable to use balls made of a material which does not react with the solid and which does not wear unduly either itself or the interior surface of the mill during the grinding. Ball mills usually contain steel or glass balls and these are suitable for the present purpose.

Preferably the SRC supplied to the grinding process is an SRC of particle size less than 250 micron.

Preferably the SRC supplied is uniformly dispersed in the gas oil and/or heavier petroleum fraction prior to grinding.

The grinding time will usually not exceed 6 minutes for an agitatory ball mill, depending on the size of the balls in the mill. As the size of the balls increases so does the grinding time.

If an SRC concentration of greater than 55% by weight is exceeded then the resulting dispersion may be too solid-like for pumping.

Preferably the oil is a fuel oil, most preferably a fuel oil having a viscosity of not more than 3500 seconds, Redwood No. 1 at 100° F. (37.8° C.). The required viscosity may be achieved by "cutting back", if necessary.

Such SRC fuel oil dispersions are suitable for use in blast furnaces, cement kilns, industrial boilers, marine boilers and utility boilers.

Diesel oil may be used and the dispersions used as a fuel for low speed diesel engines. In this case the SRC particles should be sufficiently small not to increase abrasion.

In the case of certain heavier fuel oil fractions it may be necessary to heat them in order to render them sufficiently mobile for use as grinding liquid.

The invention is illustrated with reference to the following Example.

EXAMPLE

The fuel oil was a mixed source fuel oil with a viscosity of 950 sec. Redwood 1 at 100° F. (37.8° C.). It had the following properties:

| | | | |
|---|---|---|---|
| Pour point | °C. | : | 9 |
| Total sulphur content | % wt | : | 3.29 |
| Water content | % wt | : | 0.031 |
| Relative density at 15.5° C./15.5° C. | | : | 0.963 |
| Kinematic viscosity at 50° C. | cSt | : | 122.6 |

-continued

| | | | |
|---|---|---|---|
| Kinematic viscosity at 82.2° C. | cSt | : | 30.6 |
| Kinematic viscosity at 100° C. | cSt | : | 17.5 |

The solvent refined coal had been obtained by the solvent extraction of a South African coal with anthracene oil under 2250 psig pressure of hydrogen. The coal had been preground to 99% wt less than 212 micron in a hammer mill before grinding in the fuel oil.

The fuel oil (1.95 kg) was warmed to 40° C. and the ground, solvent refined coal (1.05 kg) was added. The coal was dispersed using a high-speed vortex mixer for five minutes until a homogeneous mixture was obtained. The mixture was then pumped to a stirred ball mill sold under the trade name of Dyno Mill, Type KDL by Willy Bachofen Maschinefabrik, Basle, Switzerland, at a rate of 100 ml/min. The grinding chamber, a horizontally mounted cylinder of volume 600 ml, contained 1 mm steel balls (500 ml). The balls were stirred by agitator discs mounted on a horizontal shaft which ran parallel with the axis of the cylinder. The shaft speed was set at 4500 rpm giving a disc peripheral speed of 15 m/sec. The product was collected and passed back through the mill at the same flow rate. The total residence time of the product in the grinding chamber was 6 minutes.

The resulting dispersion was a thick, black lustrous fluid. The mean particle size of the solvent refined coal had been reduced to 3.8 micron. After standing for 6 months at ambient temperature, the dispersion showed no signs of settling. After standing for 24 hours at 100° C., the dispersion also appeared quite stable.

We claim:

1. A uniformly dispersed, stable fuel dispersion containing 15 to 55% by weight of SRC particles, the size of the majority of the particles being in the range 1 to 10 micron, in a medium consisting essentially of a gas oil and/or a heavier petroleum fraction, the percentage being expressed as a percentage by weight of the total weight of the dispersion.

2. A dispersion according to claim 1 wherein the petroleum fraction is a fuel oil.

3. A dispersion according to claim 2 wherein the fuel oil has a viscosity not greater than 3500 seconds Redwood No. 1 at 37.8° C.

4. A method for the preparation of a stable, uniform SRC-oil dispersion which method comprises grinding 15 to 55% by weight of SRC particles in the absence of free oxygen in a medium consisting essentially of gas oil and/or a heavier petroleum fraction until the size of the majority of the particles is reduced to a value in the range 1 to 10 micron, the percentage being expressed as a percentage by weight of the total weight of the dispersion.

5. A method according to claim 4 wherein grinding is carried out in a vibratory, agitatory or tumbling ball mill.

6. A method according to either claims 4 or 5 wherein the SRC supplied to the grinding process is an SRC of particle size less than 250 micron.

7. A method according to any of claims 4 to 6 wherein the SRC supplied is uniformly dispersed in the gas oil and/or heavier petroleum fraction prior to grinding.

8. A method according to any of claims 4 to 7 wherein the petroleum fraction is a fuel oil.

9. A method according to claim 8 wherein the fuel oil has a viscosity not greater than 3500 seconds Redwood No. 1 at 37.8° C.

* * * * *